United States Patent [19]

Camarota

[11] Patent Number: 4,987,845

[45] Date of Patent: Jan. 29, 1991

[54] SKI TOW FIXTURE

[75] Inventor: Richard J. Camarota, Holland, Mich.

[73] Assignee: ITC, Incorporated, Zeeland, Mich.

[21] Appl. No.: 375,271

[22] Filed: Jun. 30, 1989

[51] Int. Cl.[5] ..... B63B 21/58

[52] U.S. Cl. ..... 114/253; 114/218; 114/230

[58] Field of Search ..... 114/242, 253, 254, 230, 114/218; 248/303, 304, 339, 218.3, 216.1, 216.4, 217.4; 280/480; 24/115 R, 129 R

[56] References Cited

U.S. PATENT DOCUMENTS

| | | | |
|---|---|---|---|
| D. 32,957 | 7/1900 | Lewis | D8/382 |
| D. 187,057 | 1/1960 | Griparis | D71/1 |
| 18,107 | 9/1857 | Seaman | 114/252 |
| 926,405 | 6/1909 | Gould | 24/130 |
| 2,962,998 | 12/1960 | Long | 114/218 |
| 3,055,333 | 9/1962 | Ryan | 24/129 R X |
| 3,353,232 | 2/1966 | Brownson | 24/129 |
| 3,765,365 | 10/1973 | Gillespie | 114/218 |
| 3,890,918 | 6/1975 | Sell | 114/235 |
| 4,738,216 | 4/1988 | Camarota et al. | 114/249 |

OTHER PUBLICATIONS

Pp. 4 and 5, ITC Marine brochure.
Pp. 11, Bart's Water Ski Center brochure.

*Primary Examiner*—Sherman Basinger
*Attorney, Agent, or Firm*—Flynn, Thiel, Boutell & Tanis, P.C.

[57] ABSTRACT

A ski tow fixture for removably securing a ski tow rope to a boat hull includes a generally elongate base unit supporting two bent portions having a generally common axis of bending and being generally sidewardly spaced along the common axis and generally sidewardly aligned. The bent portions are spaced from an end of the elongate base unit. Each bent portion extends from the base unit to a free end near the above-mentioned end of the base unit.

15 Claims, 2 Drawing Sheets

SKI TOW FIXTURE

FIELD OF THE INVENTION

This invention relates to a fixture for removably securing a tow rope to the hull of a boat and, more particularly, to a fixture suitable for quick release attachment to a boat hull of a preformed loop of a rope, such as a water ski tow rope.

BACKGROUND OF THE INVENTION

Many conventional quick release ski tow fixtures include some form of a planar loop structure and a cross bar member. The cross bar member is usually disposed to extend generally across the planar loop, one end of the cross bar member being fixed to the loop or closely adjacent thereto so as to be substantially in the plane of the loop. The cross bar member extends from this fixed end in a direction generally inclined relative to the plane of the loop to a free end spaced from the plane of the loop. U.S. Pat. No. 2,962,998 granted to Long on Dec. 6, 1960, and U.S. Pat. No. 3,890,918 granted to Sell on June 24, 1975, disclose examples. Because of the cross bar structure, the ski tow fixture disclosed in these patents cannot be conveniently produced from a unitary piece of metal stock. Welding or other fastening arrangements are generally required for the cross bar member. Thus, unwanted manufacturing expenses and potential failure of the fastening arrangement are disadvantages of such ski tow fixtures.

Moreover, ski tow fixtures of that kind, which are mounted on a boat so that the cross bar is generally upstanding, are potential safety hazards. More specifically, a person who slips on a wet deck or the like and falls on the ski tow fixture could incur a puncture wound from the free end of the upstanding cross bar member.

U.S. Pat. No. 4,738,216 granted to Camarota et al. on Apr. 19, 1988 and assigned to the assignee of the present invention discloses a planar loop and cross bar structure wherein the cross bar member extends generally in the plane of the loop, and bends out of the plane of the loop only near its free end, with the free end located to avoid the safety hazard above stated (FIGS. 2 and 5–6). However, like the loop and angled cross bar structure above mentioned, this prior Camarota ski tow fixture also cannot be conveniently formed from a unitary piece of metal stock.

Accordingly, it is an object of the present invention to provide a tow apparatus for removably securing a tow rope to a boat hull and which can be formed from a unitary piece of metal stock.

It is a further object of the present invention to provide a ski tow apparatus, as aforesaid, which is simple and inexpensive to manufacture, assemble and attach to a boat hull.

It is a further object of the present invention to provide a ski tow apparatus, as aforesaid, which is adapted for quick, easy and secure attachment of a ski rope loop thereto.

It is a further object of the present invention to provide a ski tow apparatus, as aforesaid, having a generally safe construction.

SUMMARY OF THE INVENTION

An apparatus for removably securing a ski rope to a boat hull includes two bent portions having a generally common bend axis and being generally sidewardly spaced along the common bend axis. A generally elongate base unit supports the bent portions. The bent portions extend generally in the direction of the end of the base unit.

BRIEF DESCRIPTION OF THE DRAWINGS

An exemplary embodiment of the invention will be described in detail hereinafter in connection with the drawings, in which.

DETAILED DESCRIPTION

Figure 2:
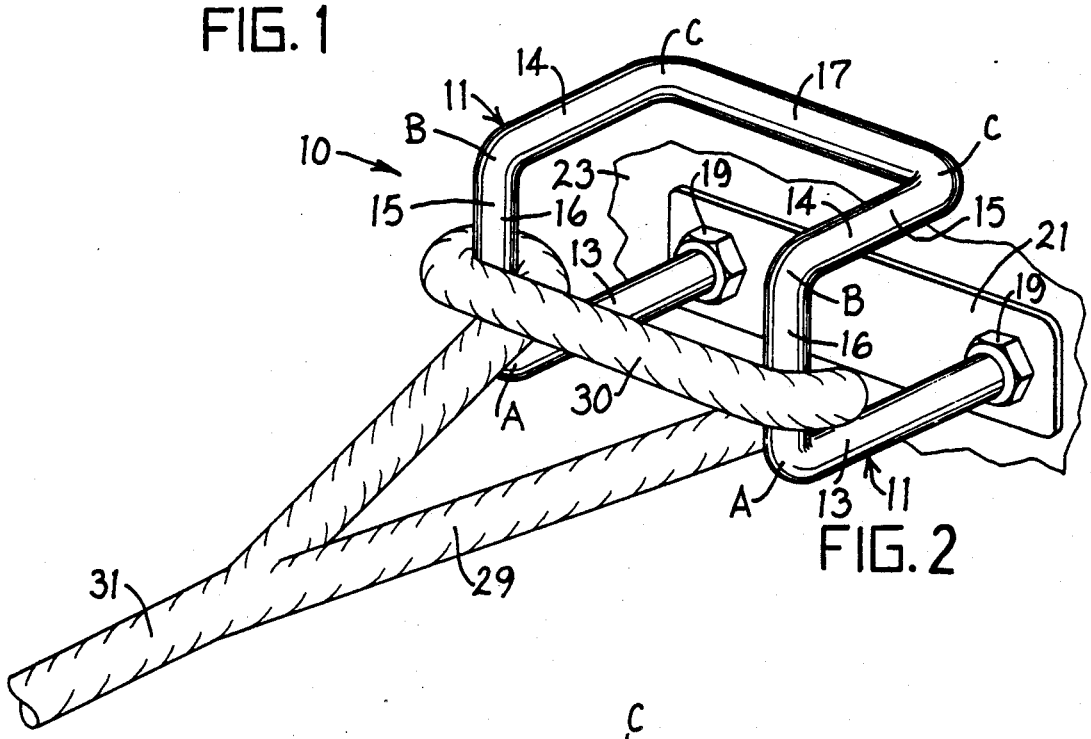
FIG. 2 is an oblique view of the inventive ski tow apparatus with rope attached.
Figure 3:
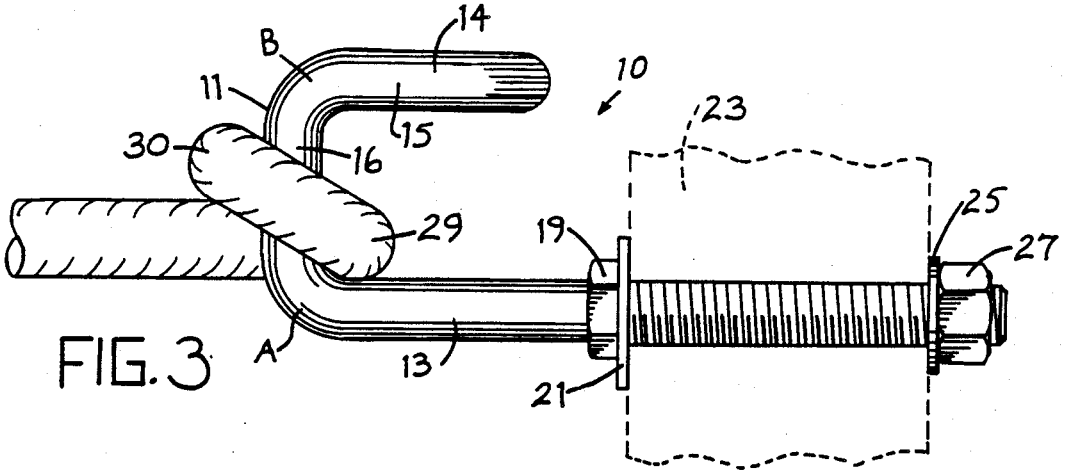
FIG. 3 is a side view of the inventive ski tow apparatus attached to a boat hull.

Referring to FIGS. 2 and 3, a ski tow fixture 10 is preferably formed from a unitary piece of suitable metal rod stock. The fixture 10 includes two preferably substantially identical, generally U-shaped, base members 11. The base members 11 are sidewardly spaced from each other.

Each generally U-shaped base member 11 is formed by a leg portion 13 and an L-shaped bent portion 15. The leg portions 13 are elongate and extend generally parallel to each other. Each leg portion is threaded from one end thereof to approximately the middle thereof. Each base member 11 is bent back upon itself to form the corresponding L-shaped bent portion 15 at the other end of the corresponding leg portion 13.

More specifically, each base member 11 has two spaced, approximately 90° bends A and B. Each generally L-shaped bent portion 15 extends integrally from the bend A at the other end of the leg portion 13 in a direction perpendicular to the leg portion 13 through the generally 90° bend B and thence in substantially overlying relationship with the leg portion 13 back in the direction of the threaded end of the leg portion 13. Each L-shaped bent portion 15 is formed by a leg 14 and a bight 16. The leg 14 extends generally parallel to the leg portion 13 and the bight 16 extends generally perpendicularly therebetween. The bight 16 is defined between the generally 90° bends A and B formed in the base member 11. Each base member 11 is substantially planar and the two base members 11 lie in substantially parallel planes, so as to define edges of a substantially rectangular space. The base members 11 are sidewardly aligned so that the respective leg portions 13, bights 16 and legs 14 are substantially co-planar. The bight 16 and leg 14 of each bent portion 15 are of approximately equal length, namely about one third of the length of the leg portions 13.

The base members 11 are connected by a transverse member 17 formed between 90° bends C at free ends of the legs 14 remote from the bends B. The transverse member 17 extends generally perpendicularly between the legs 14. The transverse member 17 defines the distance between the planes in which the base members 11 lie. In this embodiment, the transverse member has a length slightly longer than the leg 14 and bight 16 of either L-shaped bent portion 15.

Figure 4:
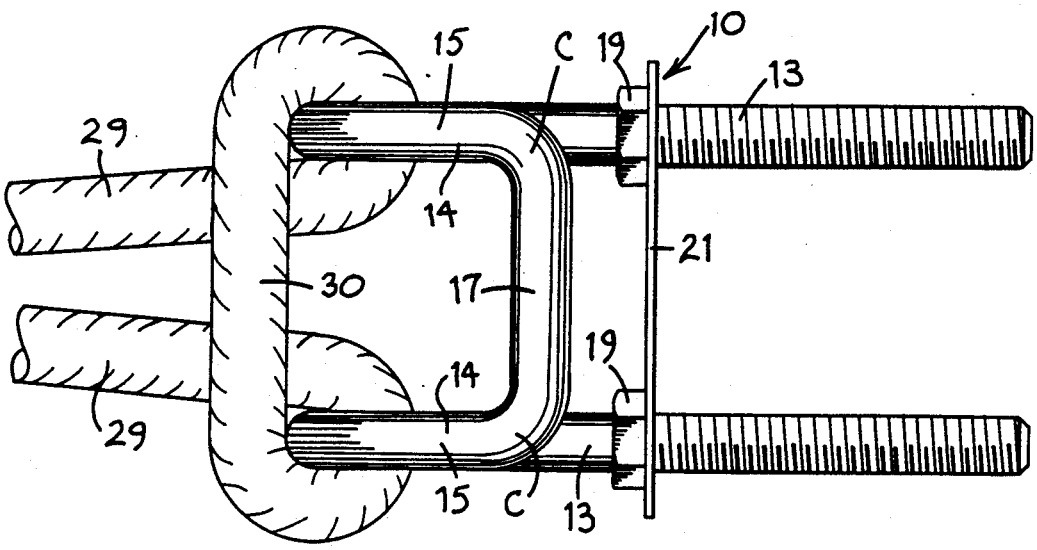
FIG. 4 is a top view of the inventive ski tow apparatus.

Exterior nuts 19 are threaded on the threaded ends of the leg portions 13 and disposed near the middle of the leg portions 13 (FIGS. 3 and 4). The threaded ends of the leg portions 13 are then passed through two spaced holes formed through a generally elongate rectangular transom plate 21.

OPERATION

Figure 6:
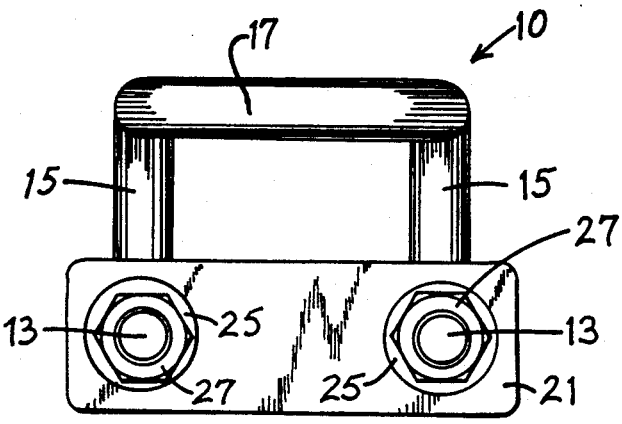
FIG. 6 is an end view of the inventive ski tow apparatus shown in FIG. 3.

In the following discussion, the term "forwardly" will refer to the normal direction of boat travel (rightward in FIG. 1), and the term "laterally" will refer to the rightward/leftward direction in FIG. 6.

Figure 1:
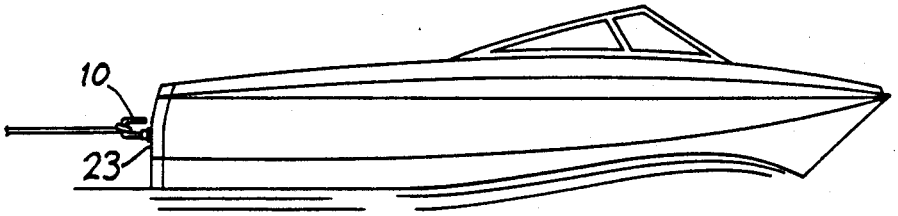
FIG. 1 is a side elevation of a boat equipped with the inventive ski tow apparatus.

To install the fixture 10 on the transom 23 of a boat, as shown in FIG. 1, the transom plate 21 is positioned flush against the nuts 19, and the threaded ends of the leg portions 13 are then inserted inboard (forwardly) through appropriate mounting holes in the transom 23 of the boat (FIGS. 1–3). The threaded ends of the leg portions 13 are long enough to extend through the transom 23, so that flat washers 25 and interior nuts 27 can be applied thereto (FIGS. 3 and 6) within the hull of the boat. With the transom plate 21 flat against the transom 23, the nuts 19 and 27 can be tightened to fixedly attach the ski tow fixture 10 to the transom 23.

Figure 5:
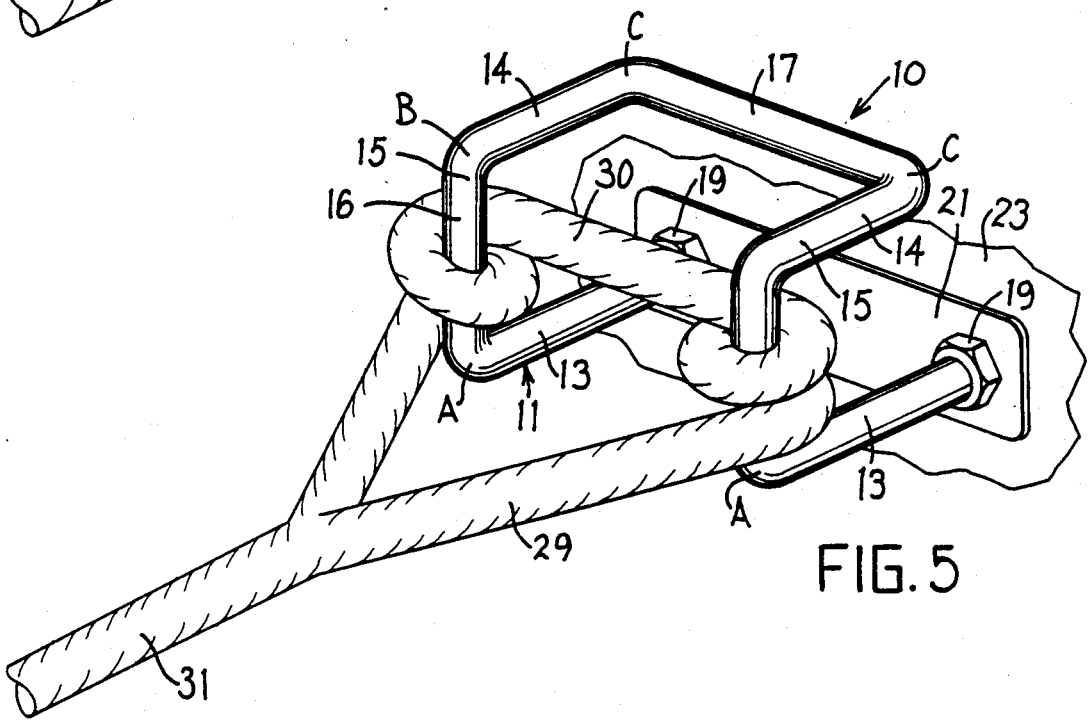
FIG. 5 is a view generally similar to FIG. 2 but showing the rope attached to the inventive ski tow apparatus in a different configuration.

Referring to FIGS. 2 and 5, two different ways of attaching the front loop 29 of a water ski tow rope 31 to the ski tow fixture 10 will now be described.

In FIG. 2, forward, central portion 30 of the rope loop 29 is inserted forwardly (rightwardly in FIG. 2) between the bights 16 of the ski tow fixture 10 and led forward beyond the transverse member 17. The central portion 30 of the rope loop 29 is then spread out laterally and pulled upward and rearward over the transverse member 17 and past the bends C. The central portion 30 of the loop 29 is then pulled downward past the bends B so as to encircle the laterally spaced bights 16. The rope 31 is then pulled rearward to tighten the grip of the loop 29 on the ski tow fixture 10. This procedure results in the fixed attachment of the rope to the fixture shown in FIGS. 2–4.

A second rope loop/fixture attachment configuration is shown in FIG. 5. This loop configuration is achieved by beginning with the loop 29 located rearwardly of the fixture 10, and then moving the loop 29 forwardly to a position above the fixture 10. The loop 29 is then dropped downwardly so that it is positioned below the legs 14 and encircles the bights 16. The loop 29 is then pulled rearwardly so that the central portion 30 thereof contacts the forward sides of the bights 16. The central portion 30 is then pulled upwardly above the legs 14 and forwardly to a position above and forward of the transverse member 17. The central portion 30 is then pulled downwardly below the transverse member 17 and rearwardly to a position below the legs 14 and rearward of the transverse member 17. The portion 30 is then pulled rearwardly along the legs 14 to the bends B and downwardly past the bends B along the bights 16. The rope 31 is then pulled in the rearward direction to achieve the configuration shown in FIG. 5. Other effective rope loop attachments are possible.

In both attachment configurations (FIGS. 2 and 5), the rope loop 29 is firmly fixed to the fixture 10 by the normal rearward pull on the rope 31 during towing, but cessation of tension on the rope 31 allows easy and quick removal of the loop 29 from the fixture 10 by a reversal of the foregoing attachment steps.

Referring to FIGS. 2 and 3, the inventive ski tow fixture 10 may be formed as follows. Starting with an appropriate length (for example 17.5 inches) of generally rounded cross-section metal (for example, stainless steel) rod stock with opposite ends (for example, about 2.75 inches each) thereof appropriately threaded. The 90° bends C are made (centered and about 2 inches apart) to form the transverse member 17, making the original metal rod generally U-shaped. Thereafter, the aligned 90° bends B can be formed simultaneously (about 1.5 inches from bends C) to define the legs 14 of the bent portions 15. Thereafter, the aligned 90° bends A may be simultaneously formed (about 1.5 inches from bends B) to define the bights 16 of the bent portions 15.

The present invention is for convenience discussed in terms of towing of water skiers by way of example only, it being understood that the towing fixture embodying the invention is useable for attachment of a rope for a variety of other purposes including but not limited to water sports such as tubing, water sledding, etc. The term "ski tow fixture" as used herein will thus be understood not to be limited to water ski towing.

Although a preferred embodiment of the invention has been disclosed in detail for illustrative purposes, it will be recognized that the scope of the present invention includes variations or modifications of the disclosed embodiment, including the rearrangement of parts.

The embodiments of the invention in which an exclusive property or privilege is claimed or defined as follows:

1. An apparatus for removably securing a ski rope to the hull of a boat, comprising:

two base members, each said base member including a leg portion and a bent portion, said leg portions and said bent portions being integrally formed, said base members being bent back upon themselves to form respective said bent portions, said leg portion having first and second ends, said bent portion being connected to said leg portion at a location spaced from said first end and said bent portion extending from said leg portion to a free end, said free end of said bent portion extending generally toward said first end of said leg portion, said leg portions lying substantially in a common plane, said bent portions extending out of said common plane and being generally sidewardly spaced from each other; and a transverse member extending generally sidewardly between and connecting said base members, said transverse member being connected to and formed integrally with said bent portions of said base members, said base members being generally sidewardly aligned relative to said transverse member so as to be substantially symmetric thereabout.

2. The apparatus of claim 1, wherein said leg portions include means at said first ends thereof for attachment to a boat hull.

3. The apparatus of claim 1, wherein said base members and said transverse member are integrally formed from a unitary piece of stock having a generally rounded cross-section.

4. The apparatus of claim 3, wherein said leg portions are generally sidewardly spaced from each other.

5. The apparatus of claim 4, wherein said leg portions are substantially parallel to each other.

6. The apparatus of claim 5, wherein said bent portions are substantially uniformly sidewardly spaced from each other by an amount generally equal to said sideward spacing between said leg portions.

7. An apparatus for removably securing a ski rope to a boat hull, comprising:

means defining two bent portions having a generally common bend axis and being generally sidewardly spaced along said common bend axis and generally sidewardly aligned; and generally elongate base means having a free end for securing said bent portions to the boat, said bent portions being fixedly supported in cantilever fashion on said base means at a location spaced from said free end of said base means, each said bent portion extending from a fixed end thereof on said base means to a cantilevered free end which is supported solely by said base means and is free of any other support, each said bent portion having a bend therein located between said fixed end and said cantilevered free end, said bent portions being arranged relative to said base means such that said cantilevered free ends of said bent portions extend from said fixed ends thereof generally in the direction of said free end of said base means, and such that said bent portions are spaced from and free of contact with the boat when secured thereto by said base means.

8. An apparatus for removably securing a ski rope to a boat hull, comprising:

means defining two bent portions having a generally common bend axis and being generally sidewardly spaced along said common bend axis and generally sidewardly aligned;

generally elongate base means for supporting said bent portions, said bent portions being spaced from a free end of said base means, each bent portion extending from said base means to a free end, said free ends of said bent portions extending generally in the direction of said free end of said base means; and a generally transverse portion extending between and connecting said generally sidewardly spaced bent portions, said transverse portion being connected to said bent portions at respective locations spaced from said base means, said base means, said bent portions, and said transverse portion being integrally formed.

9. The apparatus of claim 8, wherein said elongate base means has means at said free end thereof for attachment to a boat hull.

10. The apparatus of claim 8, wherein said base means, said bent portions and said transverse portion are formed from a unitary piece of stock having a generally rounded cross-section.

11. The apparatus of claim 10, wherein said bent portions are substantially uniformly sidewardly spaced.

12. The apparatus of claim 8, wherein said transverse portion is connected to said bent portions at said free ends thereof.

13. The apparatus of claim 12, wherein said bent portions are substantially uniformly sidewardly spaced from each other.

14. An apparatus for removably securing a ski rope to a boat hull, comprising:

a laterally spaced pair of substantially identically U-shaped base members, said base members opening forwardly and defining substantially parallel planes, said U-shaped base members each having an upstanding, rope engaging,-bight portion connecting respective rear ends of forwardly extending top and bottom legs of said base member, said top legs having front ends joined by a laterally extending transverse member, said bottom legs having front ends extending forward beyond said transverse member, said front ends of said bottom legs being threaded for extending through a transom of a towing boat, said U-shaped base members and said transverse member being integrally formed from an elongate rod, said elongate rod being bent to define a generally rectangular three-dimensional space; and threaded means coacting with the threaded front ends of said bottom legs for fixing said apparatus to the rear face of the transom, whereby a ski tow rope is releasably securable to the towing boat.

15. An apparatus for removably securing a ski rope to a towing boat, comprising:

a laterally spaced pair of substantially identically U-shaped base members, said base members opening forwardly and defining substantially parallel planes, said U-shaped base members each having an upstanding, rope engaging, bight portion connecting respective rear ends of forwardly extending top and bottom legs of said base member, said top legs having front ends joined by a laterally extending transverse member, said bottom legs having front ends extending forward beyond said transverse member, said base members and said transverse member being integrally formed from a unitary member, said front ends of said bottom legs being provided with means for fixed securement to a rear facing portion of a towing boat, whereby a ski tow rope is releasably securable to the towing boat.

* * * * *